United States Patent [19]

Gottlieb

[11] Patent Number: 4,971,323

[45] Date of Patent: Nov. 20, 1990

[54] PLAYER CONTROLLED BALL SENSING DEVICE FOR USE IN A PINBALL GAME

[76] Inventor: Alvin J. Gottlieb, 290 Cottage Hill, Elmhurst, Ill. 60126

[21] Appl. No.: 392,050

[22] Filed: Aug. 10, 1989

[51] Int. Cl.[5] ..... A63D 3/02; A63B 71/00

[52] U.S. Cl. ..... 273/129 V; 273/121 A; 200/61.11

[58] Field of Search ..... 273/129 V, 129 S, 129 W, 273/121 A; 200/61.11

[56] References Cited

U.S. PATENT DOCUMENTS

| | | | |
|---|---|---|---|
| 2,319,786 | 5/1943 | Binks | 200/52 |
| 2,328,667 | 9/1943 | Nicolaus | 200/61.11 |
| 2,507,716 | 5/1950 | Hughes | 273/118 |
| 2,727,743 | 12/1955 | Stoeser | 273/118 |
| 3,130,645 | 4/1965 | Seiden et al. | 273/118 |
| 4,189,150 | 2/1980 | Langieri | 273/121 |
| 4,203,602 | 5/1980 | Kral | 273/121 |
| 4,203,603 | 5/1980 | Konta | 273/129 |
| 4,239,222 | 12/1980 | Hori | 273/129 |
| 4,431,188 | 2/1984 | Hooker | 273/129 S |
| 4,438,928 | 3/1984 | Wiczer | 273/129 V |

OTHER PUBLICATIONS

Brochure for the "JOUST" Pinball Game Sold by Williams.

Brochure for a Pinball Game Sold by Komputer Dynamics.

Brochure for Video Games Sold by Rock'N'Ball.

*Primary Examiner*—Randall L. Green

*Assistant Examiner*—Gary Jackson

*Attorney, Agent, or Firm*—Willian Brinks Olds Hofer Gilson & Lione

[57] ABSTRACT

A pinball machine which includes apparatus attached to a game element which, when contacted by the ball during play of the game, will detect the contact of the ball. Movement of the apparatus toward the ball is controlled by a player. Preferably, the present invention also provides a scoring mechanism such that the player corresponding to the game element which last struck the ball is credited with all subsequent points scored. Another embodiment provides a dual-surface table which may be used by at least two players to play the game.

20 Claims, 3 Drawing Sheets

PLAYER CONTROLLED BALL SENSING DEVICE FOR USE IN A PINBALL GAME

BACKGROUND OF THE INVENTION

The present invention relates generally to a ball engaging mechanism for use in a rolling ball game and more particularly to a ball engaging mechanism which functions as a scoring mechanism for use on a pinball machine.

For years, pinball machines or games have provided a source of leisure time enjoyment for a variety of people. Despite the recent proliferation of computerized video arcades, pinball continues to be recognized as a popular pastime.

When playing pinball, a player sets the ball into play with a spring biased arm or plunger. As the ball strikes various scoring elements, such as post bumpers and slingshot bumpers, the player earns points according to how many times the ball strikes the bumper and the point value of each bumper. The player has no control over the movement or placement of these scoring elements, and once he or she sets the ball into motion, the ball randomly strikes various bumpers and other scoring elements.

Because the ball rolling or playing surface of the pinball table is gently sloped, the force of gravity constantly urges the ball towards the base of the table. Usually mounted near the base of the table are two flippers which may be electronically actuated by the player by depressing buttons located on the side of the machine's cabinet. By correctly timing the actuating of the flippers, the player can cause the flippers to strike the ball and propel it into the playing area to again contact the various scoring elements and score further points.

In contrast with the bumpers or other scoring elements, movement of the flippers is within the control of the player. These flippers do not detect ball contact like the bumpers, however, and no points are scored as a result of contact between the flipper and the ball. The flippers are merely ball propelling devices. The primary purpose of the flipper has been to keep the ball in play and prevent it from escaping the playing field by passing through the space located between the flippers thereby ending the play of that particular ball. This limited control over the scoring elements of the game leaves the present pinball game with some deficiencies.

As developed over the years, pinball is primarily an individual activity. One player controls both flippers and the score is tabulated on a "per ball" basis. Although it is possible on tables that employ independently actuated flippers for a first player to control the actuation of one flipper and a second player to control the actuation of a second flipper, a single score is tabulated preventing the players from distinguishing themselves on the basis of score.

Most pinball machines allow two players to "compete" with one another by allowing a first player to play one ball and retaining that player's score on a visible scoring board. The second player then plays a ball which is scored separately. Thus, at the conclusion of the second player's play of the game, the two players can compare scores to see who scored the greatest number of points and thereby determine the winner.

The primary problem with competitive pinball played on a machine as described above is that only one player can play at one time. Thus, there is always one player who is not involved in the activity of the game. If one player has a particularly long round, the resting player may become bored and lose interest in the game.

Another disadvantage to "competitive" play when players play consecutive rounds and compare scores is that it lacks the excitement and drama of games wherein players play simultaneously. Missing is a constant comparison of scores which occurs throughout the game; indeed, when competing by playing consecutive rounds, the winner is not known until after the final player completes the round.

Moreover, competitive play through playing consecutive rounds does not allow the players to exercise any strategy against each other. The way one player plays the game has no impact on how the other player plays the game. There is no opportunity to assume an offensive or defensive posture with respect to the other player. In fact, what results from such "competitive" play is that the first player actually competes with the machine and then the second player competes with the machine. The players then compare scores to ascertain who performed better against the machine. The players are not truly competing against each other.

SUMMARY OF THE INVENTION

In view of the above, it is an objective of this invention to provide substantially direct player control over the movement of the scoring elements in a game such as a pinball game or machine. In one aspect of the invention, such player control is achieved by providing a ball engaging element having an impact or contact surface which can detect contact with the ball and a control element that permits the player to move the impact surface into the path of the ball to establish contact with the ball.

In another variation of the invention, a dual-surface table is employed with the table configured such that opponents stand at opposite sides of the table. Each surface is sloped downwardly towards the respective player and is joined in the middle along a ridge. The ball is free to travel over the ridge and score points on either surface of the table. When utilizing a dual surface table, each player has control over the ball engaging mechanisms located on that player's side of the table.

In one preferred embodiment, these ball engaging mechanisms are equipped with a sensor which detects contact between the ball and that player's ball engaging mechanism. During play of the game on a dual-surface table, the player who has last contacted the ball with the ball engaging mechanism under that player's control is credited with any subsequently scored points.

The present invention will be further understood in view of the following detailed description of some presently preferred embodiments of the invention taken in conjunction with the accompanying drawings.

DETAILED DESCRIPTION OF PRESENTLY PREFERRED EMBODIMENTS OF THE INVENTION

Figure 1:
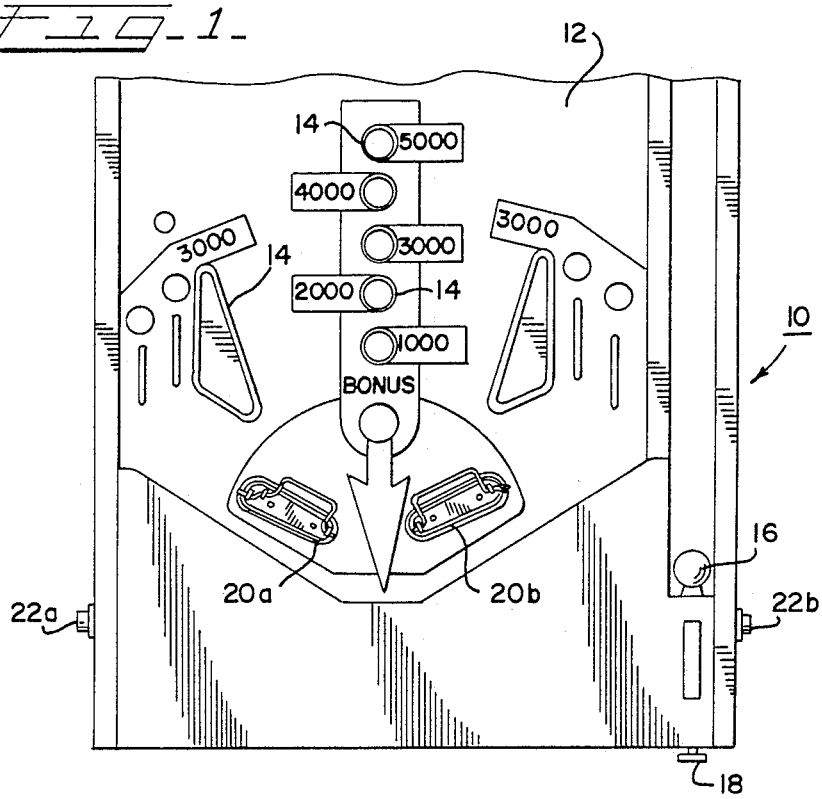
FIG. 1 is a top plan view of a pinball table which employs sensor-equipped flippers made in accordance with the present invention.

Reference is now made to the figures wherein like parts are referred to by like numerals throughout. In FIG. 1, a rolling ball game with a ball rolling surface or playing surface 12 is generally designated at 10. More particularly, FIG. 1 shows a pinball game or pinball machine. Although the following description of the invention is directed to a pinball machine, it will be recognized that the invention may be used on other games including games which do not use a "pinball" per se, or which use a puck, cylinder or other figure which may roll or slide on the playing surface.

A plurality of ball-engaging mechanisms 14 are mounted on playing surface 12. The ball engaging mechanisms 14 may include a variety of elements such as post bumpers and slingshot bumpers, as well as other similar ball-engaging mechanisms which are well known in the art.

The ball engaging mechanisms have a point value assigned to them such that when they are struck with a ball 16 during the play of the game, the player is credited with an assigned point value. Additionally, most conventional ball-engaging mechanisms include an element which propels the ball away from the ball engaging mechanism when contacted by the ball, such as leaf or trigger switches (not shown).

The pinball machine 10 further includes a plunger 18 which is biased with a spring (not shown), used to propel a ball 16 onto the ball rolling or playing surface 12 for play. The player stands at the end of the machine where the plunger 18 is located. The playing surface 12 is sloped at a slight angle with respect to the horizontal so that the ball rolls towards the player. The ball contacts the ball engaging mechanisms 14, and eventually works its way towards the player. One or more ball-engaging mechanisms are operable by the player by means of a control element. As illustrated in FIG. 1, flippers 20*a* and 20*b* with their corresponding control buttons 22*a* and 22*b* are such moveable player-controlled ball engaging mechanisms.

Both flippers 20*a* and 20*b* can be actuated by pressing only one flipper button 22*a* (or 22*b*), or alternatively, each flipper may be controlled by a separate control mechanism. In this embodiment, the left flipper button 22*a* corresponds to the left flipper 20*a* and the right flipper button 22*b* corresponds to the right flipper 22*b*, thereby allowing for independent actuation of the flippers 20*a* and 20*b*.

Figure 2:
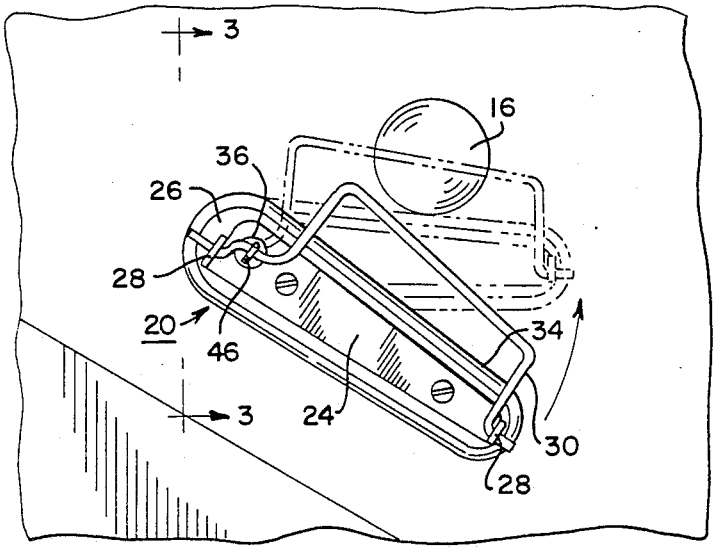
FIG. 2 is an enlarged top plan view of a flipper utilized on the pinball table of FIG. 1.
Figure 3:
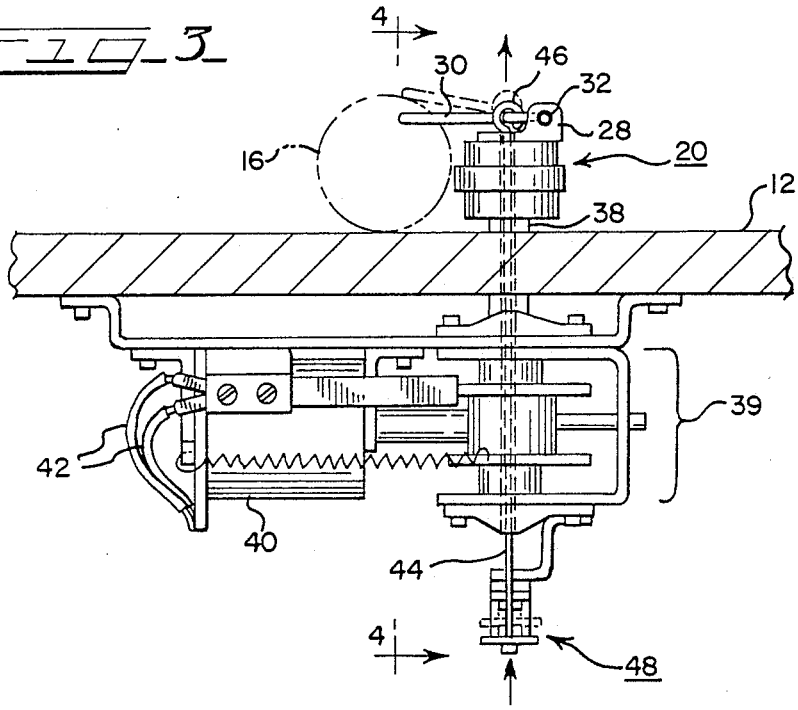
FIG. 3 is a sectional view taken along line 3—3 of FIG. 2.
Figure 4:
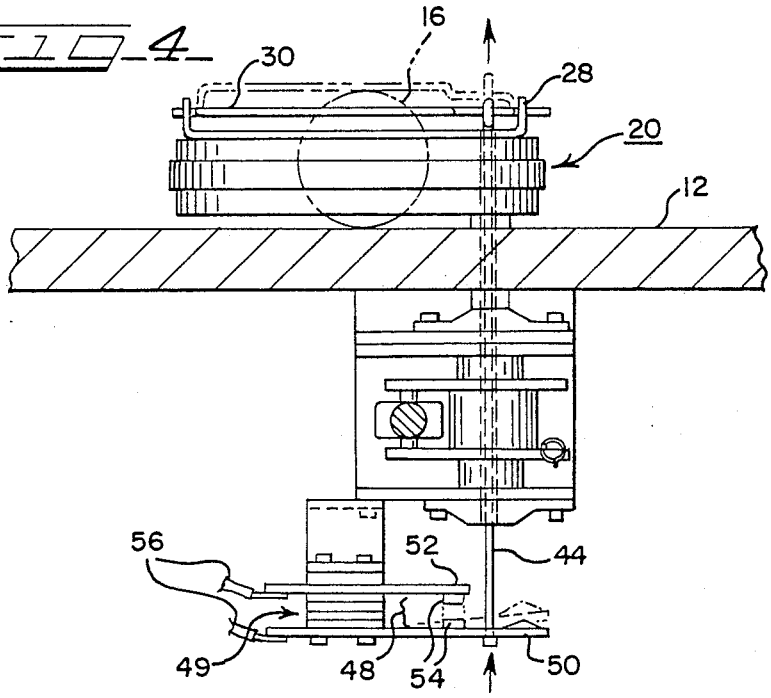
FIG. 4 is a sectional view taken along line 4—4 of FIG. 3.

Means are provided for detecting contact of the moveable ball engaging mechanisms 20 —the flippers— with the ball 16. A preferred embodiment of the means for detecting contact with the ball is illustrated in FIGS. 2–4 in combination with flipper 20*a*. The flipper 20*a* includes a mounting bracket 24 which is attached to the top of flipper body 26. The mounting bracket 24 has an ear or eyelet 28 located on each end (best illustrated in FIG. 3). Alternatively, the mounting bracket and ears could be molded as an integral part of the flipper body.

A U-shaped wire bar or gate 30 is pivotally mounted to the mounting bracket 24 by affixing each end of the wire gate 30 through an aperture 32 located in each ear 28 (FIGS. 2 and 3). The wire gate 30 rests in a plane slightly lower than the height of the ball 16. When the ball 16 contacts the leading edge 34 of the flipper 20*a*, the wire gate 30 is forced upwardly by the ball 16 and pivots about the ears 28.

Flipper 20*a* is mounted on a pivot pin 38 which is attached to a standard pinball flipper mechanism 39 including a standard solenoid 40. When a player presses the flipper button 22*a*, which is electrically connected to the solenoid 40 by means of lead wires 42, the solenoid 40 causes the pivot pin or shaft 38 to rotate thereby moving the flipper 20*a* to the position illustrated in the phantom lines of FIG. 2.

As illustrated in FIG. 3, a translating wire 44 is attached to the wire gate 30 by means of a loop 46 formed in the upper end of the wire 44. As best illustrated in FIG. 2, the loop 46 is attached to the wire gate 30 adjacent the pivot pin 38. When the ball 16 contacts the flipper 20*a*, causing the wire gate 30 to raise to the position illustrated in the phantom lines of FIG. 3, the translating wire 44 is also raised.

The translating wire 44 is connected to an electrical contact switch or relay 48 (FIG. 4). The relay 48 includes a first contact 52 and a second contact 54. The second contact 54 rests on cantilever 50. A first end of cantilever 50 is fixedly attached to a cantilever base 49. A second end of cantilever 50 extends beyond the second contact 54. The lower end of translating wire 44 passes down through an aperture in pivot pin 38 and extends through and is secured beneath the second end of cantilever 50. The second contact 54 is spring biased towards the horizontal, and therefore acts to bias the wire gate 30 in a downward position where it will contact the ball 16 in the event the ball 16 comes into contact with the flipper 20*a*.

When the wire gate 30 is raised, the lower contact 50 moVes to the position illustrated in the phantom lines of FIG. 4, causing contacts 54 and 52 to engage. A pair of lead wires 56 are connected to the relay 48 and lead to a scoring mechanism for recording scores. Such scoring mechanisms are well known in the art and therefore no further details are given here. Advantageously, the flipper scoring mechanism just discussed is not actuated through the typical vibrations that occur during the play of the game.

Besides scoring points from the flipper engagement itself, the scoring mechanism also thereafter credits points scored as the ball 16 hits various other scoring elements 14 to the player corresponding to the flipper 20*a* that last contacted the ball 16. For example, in the embodiment of the invention illustrated in FIG. 1, a first player maintains control over the left flipper with a second player maintaining control over the right flipper. When the first player's flipper comes into contact with the ball 16, the wire gate 30 is raised, thereby actuating the relay 48 and triggering the scoring mechanism. With the scoring mechanism triggered in favor of the first player, all subsequent points scored as the ball strikes various scoring elements 14 are credited to the first player. The first player will continue to score points until the second player's flipper gate comes into contact with the ball 16, thereby triggering the scoring mechanism in favor of the second player.

Figure 6:
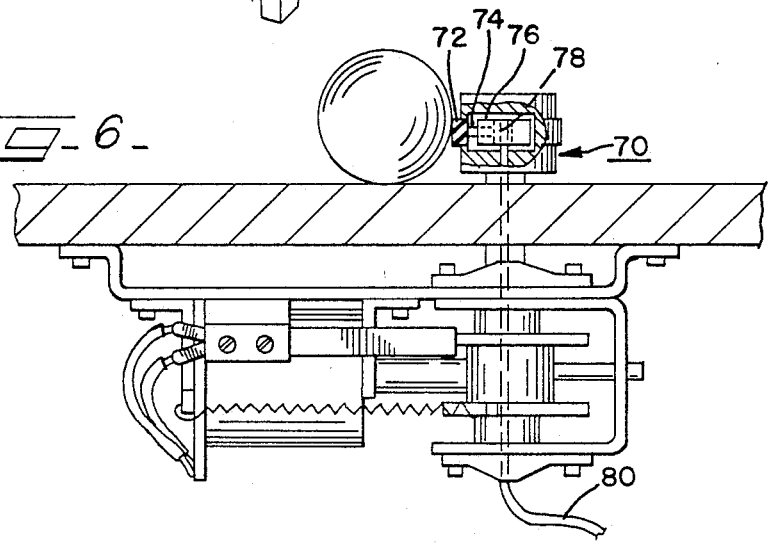
FIG. 6 is a sectional view similar to that of FIG.3 of an alternative embodiment of a flipper made in accordance with the present invention.

Another embodiment of a means for detecting contact with the ball 16 is shown in FIG. 6. A flipper is illustrated with a bumper 72, such as is typically included on most conventional flippers. The bumper 72, however, is modified with a sliding or plunger-type contact 74 within and running the length of the bumper 72. The contact 74 is attached to the inside of the bumper 72, which is usually made of an elastic material, thereby biasing the sliding contact 74 outboard relative to the bumper 72.

When a player actuates the flipper mechanism making contact with the ball 16, the ball 16 strikes the bumper 72. The force of the ball 16 against the bumper 72 causes the contact 74 to move through a channel 76 to engage a stationary contact 78. Lead wires 80 are connected to the scoring mechanism to trigger the scoring mechanism upon engagement of contact 78, thereby indicating that subsequent points scored are to be attributed to the player operating that flipper.

It will be appreciated that, in addition to those disclosed above, a variety of similar means may be provided for detecting contact with the ball on player controlled ball engaging mechanisms. For example, ball contact could be detected by breaking of a constant beam of light or by magnetic sensitive contacts.

It will further be appreciated that not only flippers, but other ball engaging mechanisms may also include such means for player control and ball detection. For example, in some variations of the game, it may be desirable to include such means for player control of movement of a scoring element such as a bumper which contains ball detecting means. Additionally, it may be desirable to include a specially designated bumper with means for detecting contact with the ball so that the ability to score points is not solely a function of whose flipper was last to contact the ball.

Figure 5:
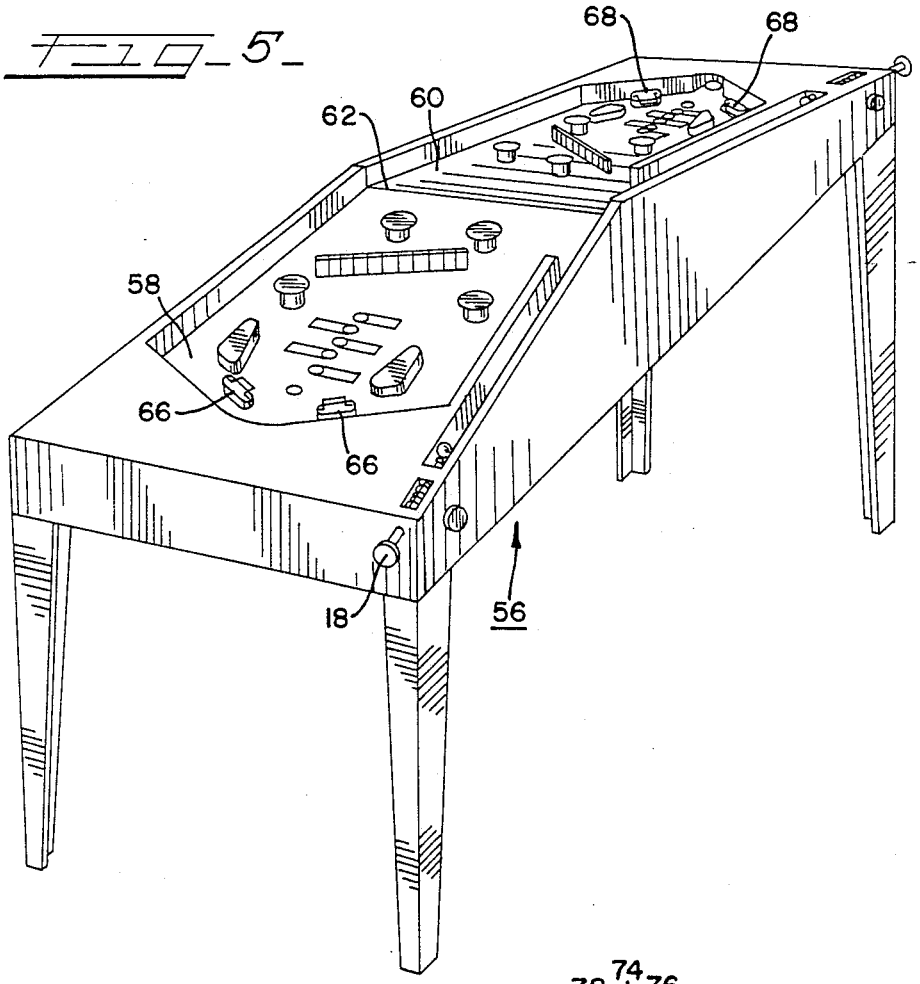
FIG. 5 is a perspective view of a dual-surface pinball table made in accordance with another aspect of the present invention.

Another embodiment of the invention is illustrated in FIG. 5. In FIG. 5, a dual-surface pinball table is generally designated at 56. The dual-surface pinball table 56 includes a first playing surface 58 and a second playing surface 60. When playing competitive pinball with a dual-surface pinball table, a first player stands at the end of the first playing surface 58, with a second player standing at the end of the second playing surface 60.

Both playing surfaces 58 and 60 are inclined at an angle with respect to the horizontal. Each surface meets at a ridge 62. The ball 16 can roll over the ridge 62 onto either playing surface.

Each playing surface has a variety of scoring elements 64 attached thereto. Additionally, a pair of flippers 66 and 68 is provided on each playing surface. In one embodiment, these flippers are configured substantially the same as those illustrated in FIGS. 2 through 4. However, when utilizing a dual-surface table 56, it is preferable that the flippers 66, 68 be connected such that both flippers in a pair correspond to the player standing at the end of a respective playing surface.

During play of the game on such a dual-surface table, when the one player's flipper comes into contact with the ball, the wire gate on that flipper will raise, thereby triggering his or her scoring mechanism. All points thereafter scored are credited to that player, regardless of the playing surface on which the ball is located when the points are scored, until such time as another player's flipper comes into contact with the ball triggering his or her scoring mechanism.

A dual-surface table could also be adapted to provide a competitive pinball game in which four players can play simultaneously. By adjusting the scoring mechanism to record four separate scores and assigning one player to each flipper, similar to the embodiment of FIG. 1, four players would be able to independently score points and thereby compete with each other.

The invention may be embodied in other forms than those specifically disclosed herein without departing from its spirit or essential characteristics. The described embodiments are to be considered in all respects only as illustrative and not restrictive, and the scope of the invention is commensurate with the appended claims rather than by the foregoing description.

I claim:

1. A rolling ball game including a playing surface and a ball engaging mechanism, the ball engaging mechanism comprising:

a ball engaging element including a contact surface, the ball engaging element movably mounted relative to the playing surface;

a sensor operatively connected to the ball engaging element to detect impact with the contact surface;

a scoring mechanism operatively connected to the sensor such that points are allocated to the player upon impact by a ball with the contact surface;

a control element operable by a player; and an actuating mechanism operatively connected to move the ball engaging element about the playing surface in response to movement of the control element.

2. A rolling ball game as defined in claim 1 further comprising:

a second ball engaging mechanism operable by a second player;

a scoring element operatively connected to said first and second ball engaging mechanisms wherein the scoring element allocates points scored to player one from the time the first ball engaging mechanism makes contact with the ball until the second ball engaging mechanism makes contact with the ball or until the ball drops below the playing surface;

a scoring element operatively connected to said first and second ball engaging mechanisms wherein the scoring element allocates points scored to the second player from the time the second ball engaging mechanism makes contact with the ball until the first ball engaging mechanism makes contact with the ball or until the ball drops below the ball rolling surface.

3. A ball engaging element for use with a ball on a pinball game, comprising:

an impact surface capable of movement towards the ball;

detecting means connected to the impact surface for detecting contact between the ball and the impact surface;

scoring means connected to the detecting means for allocating points to the player upon impact by the ball with the impact surface; and means connected to the impact surface for permitting the player to control movement of the impact surface towards the ball.

4. A ball engaging element for use with a ball on a pinball game as defined in claim 3, wherein the impact surface comprises a flipper mounted on the playing surface for pivotal movement.

5. A ball engaging element for use with a ball on a pinball game as defined in claim 4, wherein the detecting means comprises a wire gate extending outwardly from the impact surface.

6. A ball engaging element for use with a ball on a pinball game as defined in claim 5, wherein the wire gate is configured such that it is capable of movement from a first position to a second position, when the ball comes into contact With the impact surface.

7. A ball engaging element for use with a ball on a pinball game as defined in claim 6, further comprising means in connection with the wire gate for transmitting an electrical signal upon movement of the wire gate from the first position to the second position.

8. A ball engaging element as defined in claim 7 for use with a ball on a pinball game, wherein the transmitting means comprises an electrical contact switch operatively connected to the wire gate; the electrical contact switch configured to close when the wire gate moves from the first position to the second position.

9. A ball engaging element as defined in claim 6 for use with a ball on a pinball game, further comprising means for biasing the wire gate toward the first position.

10. A flipper for use in a pinball game including a ball and a playing surface, the flipper comprising:

a flipper arm pivotally mounted on the playing surface by means of a shaft said flipper arm having a top surface, a bottom surface, an impact surface and a first and second end;

a mounting bracket secured to the top surface of the flipper arm having a first ear near the first end of the flipper arm and a second ear near the second end of the flipper arm;

a wire gate with the ends of the wire gate pivotally mounted on the first and second ears of the mounting bracket such that the wire gate projects outwardly from the impact surface of the flipper arm;

a transferring wire with an upper and lower end slidably mounted within a vertical aperture in the shaft, said upper end of said transferring wire having a looped end extending up through the flipper arm and the mounting bracket with said loop movably mounted on the wire gate, said lower end of said transferring wire projecting out beyond the end of the flipper arm shaft;

an electrical contact switch near the lower end of the transferring wire, said transferring wire operatively connected to one-half of the electrical contact switch such that the electrical contact switch is open when the wire gate is in its lowest position and the electrical contact switch is closed when the wire gate is raised.

11. A rolling ball game comprising:

a playing surface;

a first ball engaging mechanism including a first ball engaging element having a contact surface, the first ball engaging element movably mounted relative to the playing surface, a first sensor operatively connected to the first ball engaging element to detect impact with the contact surface of the first ball engaging element;

a second ball engaging mechanism including a second ball engaging element having a contact surface, the second ball engaging element movably mounted relative to the playing surface, a second sensor operatively connected to the second ball engaging element to detect impact with the contact surface of the second ball engaging element;

a scoring element operatively connected to said first and second ball engaging mechanisms wherein the scoring element allocates points scored to the first player from the time the first ball engaging mechanism makes contact with the ball until the second ball engaging mechanism makes contact with the ball or until the ball drops below the playing surface;

a scoring element operatively connected to said first and second ball engaging mechanisms wherein the scoring element allocates points scored to the second player from the time the second ball engaging mechanism makes contact with the ball until the first ball engaging mechanism makes contact with the ball or until the ball drops below the playing surface;

a control element for each the said first and second ball engaging mechanisms operable by the first and second players respectively;

an actuating mechanism operatively connected to move the ball engaging element of the said first and second ball engaging mechanisms about the playing surface in response to the movement of the control element.

12. The rolling ball game of claim 11 wherein the playing surface comprises:

a first surface disposed at an angle with respect to the horizontal, the first surface having an upper edge lying in a horizontal plane;

a second surface disposed at an angle with respect to the horizontal, the second surface having an upper edge extending in a horizontal direction, the upper edge of the first surface meeting the upper edge of the second surface to form a ridge that the ball may roll over to get from the first surface to the second surface.

13. The rolling ball game of claim 12 wherein the first ball engaging element comprises a first flipper pivotally mounted to the first surface and the second ball engaging element comprises a second flipper pivotally mounted to the second surface.

14. The rolling ball game as defined in claim 11 wherein the first and second ball engaging elements comprise pivotally mounted flippers.

15. A ball engaging element for use with a ball on a pinball game, comprising:

a flipper pivotally mounted on the playing surface including an impact surface capable of movement towards the ball;

detecting means connected to the impact surface for detecting contact between the ball and impact surface;

means for allocating points to the player upon impact of the ball on said flipper; and means connected to the impact surface for permitting the player to control movement of the impact surface towards the ball.

16. A ball engaging element for use with a ball on a pinball game as defined in claim 15, wherein the detecting means comprises a wire gate extending outwardly from the impact surface.

17. A ball engaging element for use with a ball on a pinball game as defined in claim 16, wherein the wire gate is configured such that it is capable of movement from a first position to a second position, when the ball comes into contact with the impact surface.

18. A ball engaging element for use with a ball on a pinball game as defined in claim 17, further comprising means in connection with the wire gate for transmitting an electrical signal upon movement of the wire gate from the first position to the second position.

19. A ball engaging element as defined in claim 18 for use with a ball on a pinball game, wherein the transmitting means comprises an electrical contact switch operatively connected to the wire gate; the electrical contact switch configured to close when the wire gate moves from the first position to the second position.

20. A ball engaging element as defined in claim 17 for use with a ball on a pinball game, further comprising means for biasing the wire gate toward the first position.

* * * * *